US006419559B1

(12) United States Patent
Gurusamy et al.

(10) Patent No.: US 6,419,559 B1
(45) Date of Patent: Jul. 16, 2002

(54) USING A PURGE GAS IN A CHEMICAL MECHANICAL POLISHING APPARATUS WITH AN INCREMENTALLY ADVANCEABLE POLISHING SHEET

(75) Inventors: Jayakumar Gurusamy, Mountain View; Gee Sun Hoey, San Jose, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/901,959

(22) Filed: Jul. 9, 2001

Related U.S. Application Data

(60) Provisional application No. 60/217,254, filed on Jul. 10, 2000.

(51) Int. Cl.[7] ..... B24B 1/00

(52) U.S. Cl. ..... 451/41; 451/56; 451/296; 451/444

(58) Field of Search ..... 451/41, 59, 60, 451/56, 285, 286, 287, 288, 289, 296, 299, 300, 307, 444

(56) References Cited

U.S. PATENT DOCUMENTS

| | | | | |
|---|---|---|---|---|
| 3,853,637 A | * | 12/1974 | Gary et al. | 451/36 |
| 4,347,689 A | | 9/1982 | Hammond | |
| 4,635,408 A | * | 1/1987 | Burke et al. | 451/60 |
| 4,642,943 A | | 2/1987 | Taylor, Jr. | |
| 5,001,873 A | * | 3/1991 | Rufin | 451/76 |
| 5,065,547 A | | 11/1991 | Shimizu et al. | |
| 5,088,240 A | | 2/1992 | Ruble et al. | |
| 5,099,615 A | | 3/1992 | Rube et al. | |
| 5,209,027 A | | 5/1993 | Ishida et al. | |
| 5,276,999 A | | 1/1994 | Bando | |
| 5,335,453 A | | 8/1994 | Baldy et al. | |
| 5,399,125 A | | 3/1995 | Dozier | |
| 5,476,413 A | | 12/1995 | Hasegawa et al. | |
| 5,486,132 A | * | 1/1996 | Cavaliere et al. | 451/75 |
| 5,487,697 A | | 1/1996 | Jensen | |
| 5,490,808 A | | 2/1996 | Jantschek et al. | |
| 5,558,568 A | | 9/1996 | Talieh et al. | |
| 5,593,344 A | | 1/1997 | Weldon et al. | |
| 5,660,581 A | | 8/1997 | Shin et al. | |
| 5,676,590 A | | 10/1997 | Hiraoka | |
| 5,692,947 A | | 12/1997 | Talieh et al. | |
| 5,704,827 A | | 1/1998 | Nishi et al. | |
| 5,722,877 A | | 3/1998 | Meyer et al. | |
| 5,762,536 A | | 6/1998 | Pant et al. | |
| 5,800,248 A | | 9/1998 | Pant et al. | |
| 5,871,390 A | | 2/1999 | Pant et al. | |
| 5,897,426 A | | 4/1999 | Somekh | |
| 5,899,801 A | | 5/1999 | Tolles et al. | |
| 5,921,560 A | * | 7/1999 | Moshtagh | 451/388 |
| 5,997,384 A | | 12/1999 | Blalock | |
| 6,068,542 A | | 5/2000 | Hosokai | |
| 6,126,512 A | * | 10/2000 | Chao et al. | 451/297 |
| 6,135,859 A | * | 10/2000 | Tietz | 451/309 |
| 6,244,935 B1 | | 6/2001 | Birang et al. | |

FOREIGN PATENT DOCUMENTS

| | | |
|---|---|---|
| EP | 0 756 917 A1 | 2/1997 |
| EP | 0 818 272 A1 | 1/1998 |
| JP | 62-162466 | 7/1987 |
| JP | 2-269553 | 11/1990 |
| JP | 4-250967 | 9/1992 |
| JP | 7-111256 | 4/1995 |

* cited by examiner

*Primary Examiner*—Joseph J. Hail, III
*Assistant Examiner*—Hadi Shakeri
(74) *Attorney, Agent, or Firm*—Fish & Richardson

(57) ABSTRACT

A chemical mechanical polishing apparatus has a rotatable platen, a feed roller located in a cavity in the platen, a take-up roller, and a generally linear polishing sheet releasably secured to the platen to rotate with the platen. The polishing sheet has an exposed portion extending over a top surface of the platen for polishing the substrate, an unused portion wound around the feed roller, and a used portion wound around the take-up roller. A gas source direct a purge gas into the cavity containing the feed roller.

7 Claims, 5 Drawing Sheets

USING A PURGE GAS IN A CHEMICAL MECHANICAL POLISHING APPARATUS WITH AN INCREMENTALLY ADVANCEABLE POLISHING SHEET

CROSS-REFERENCE TO RELATED APPLICATIONS

This application claims priority to Provisional U.S. Application Ser. No. 60/217,254, filed Jul. 10, 2000.

BACKGROUND

The present invention relates to apparatus and methods for chemical mechanical polishing a substrate.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface can present problems in the photolithographic steps of the integrated circuit fabrication process. Therefore, there is a need to periodically planarize the substrate surface. In addition, plaranization is needed when polishing back a filler layer, e.g., when filling trenches in a dielectric layer with metal.

Chemical mechanical polishing (CMP) is one accepted method of planarization. This planarization method typically requires that the substrate be mounted on a carrier or polishing head. The exposed surface of the substrate is placed against a polishing pad, e.g., a circular pad or linear belt, that moves relative to the substrate. The polishing pad may be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

During CMP operations, the polishing pad needs to be replaced periodically. For a fixed-abrasive pad, the substrate wears away the containment media to expose the embedded abrasive particles. Thus, the fixed-abrasive pad is gradually consumed by the polishing process. After a sufficient number of polishing runs the fixed-abrasive pad needs to be replaced. For a standard pad, the substrate thermally and mechanically damages the polishing pad and causes the pad's surface to become smoother and less abrasive. Therefore, standard pads must be periodically "conditioned" to restore a roughened texture to their surface. After a sufficient number of conditioning operations, the conditioning process consumes the pad or the pad is unable to be properly conditioned. The pad must then be replaced.

One problem encountered in the CMP process is difficulty in replacing the polishing pad. The polishing pad may be attached to the platen surface with an adhesive. Significant physical effort is often required to peel the polishing pad away from the platen surface. The adhesive then must be removed from the platen surface by scraping and washing with a solvent. A new polishing pad can then be adhesively attached to the clean surface of the platen. While this. is happening, the platen is not available for the polishing of substrates, resulting in a decrease in polishing throughput.

SUMMARY

In one aspect, the invention is directed to a chemical mechanical polishing apparatus that has a rotatable platen, a feed roller located in a cavity in the platen, a take-up roller, and a generally linear polishing sheet releasably secured to the platen to rotate with the platen. The polishing sheet has an exposed portion extending over a top surface of the platen for polishing the substrate, an unused portion wound around the feed roller, and a used portion wound around the take-up roller. The apparatus also has a drive mechanism to incrementally advance the polishing sheet in a linear direction across the top surface of the platen, and a gas source that directs a purge gas into the cavity containing the feed roller.

Implementations of the invention may include one or more of the following features. The purge gas may maintain the cavity at a pressure greater than atmospheric pressure. The purge gas may be nitrogen. The apparatus may have a door to the cavity pivotally attached to the platen.

In another aspect, the invention is directed to a method of operating a chemical mechanical polishing apparatus. In the method, a generally linear polishing sheet is positioned with an unused portion wound around a feed roller in a cavity of a rotatable platen, an exposed portion extending over a top surface of the platen, and a used portion wound around a take-up roller. A purge gas is directed into the cavity containing the feed roller. The platen rotates, and the polishing sheet advances in a linear direction across the top surface of the platen.

Implementations of the invention may include one or more of the following features. The purge gas may maintain the cavity at a pressure greater than atmospheric pressure. The purge gas may be nitrogen.

Potential advantages of the invention may include the following. Contamination on the unused portion of the polishing sheet may be reduced, thereby decreasing defects and increasing yield.

Other features and advantages will be apparent from the following description, including the drawings and claims.

DETAILED DESCRIPTION

Figure 1:
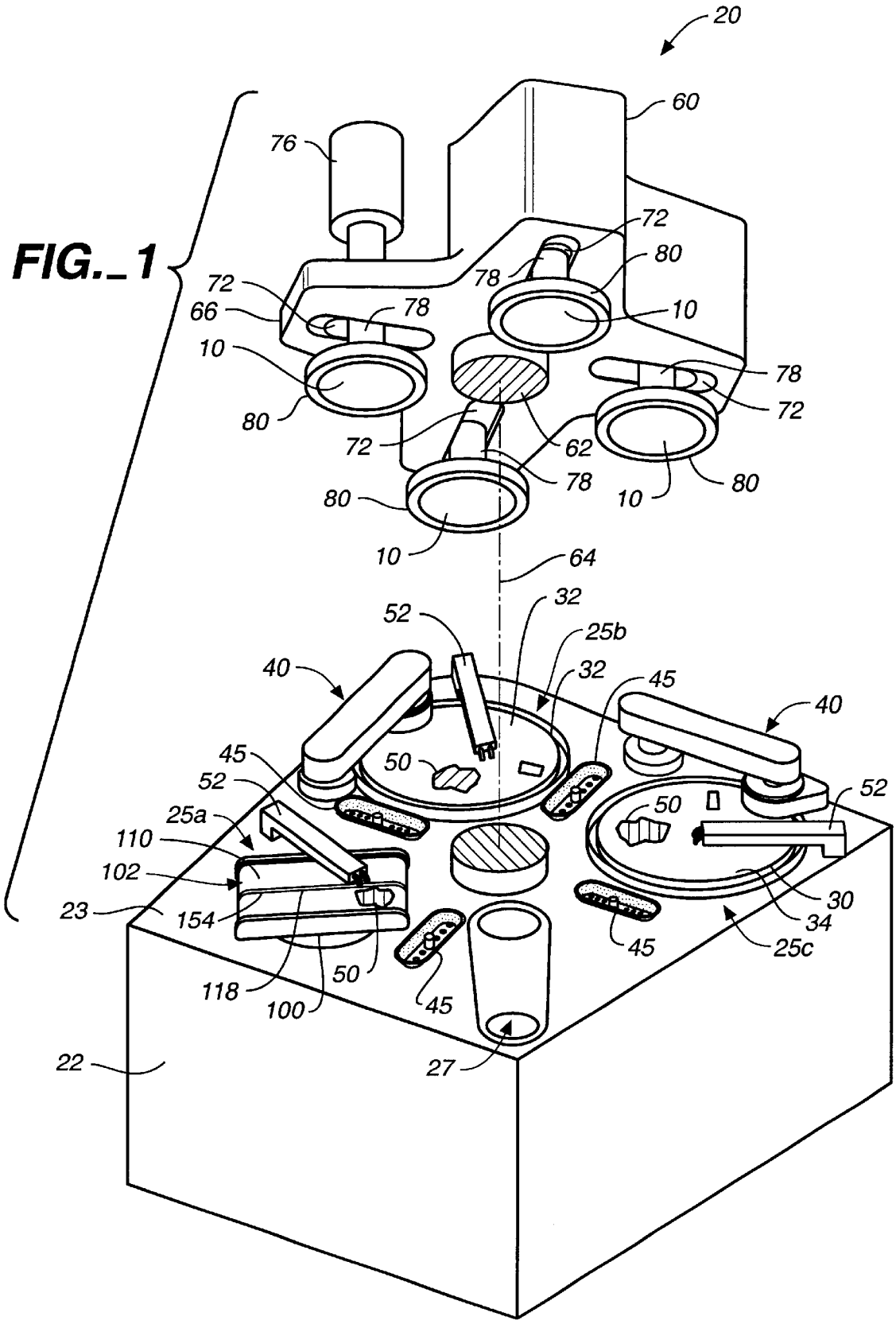
FIG. 1 is a schematic exploded perspective view of a chemical mechanical polishing apparatus.
Figure 2:
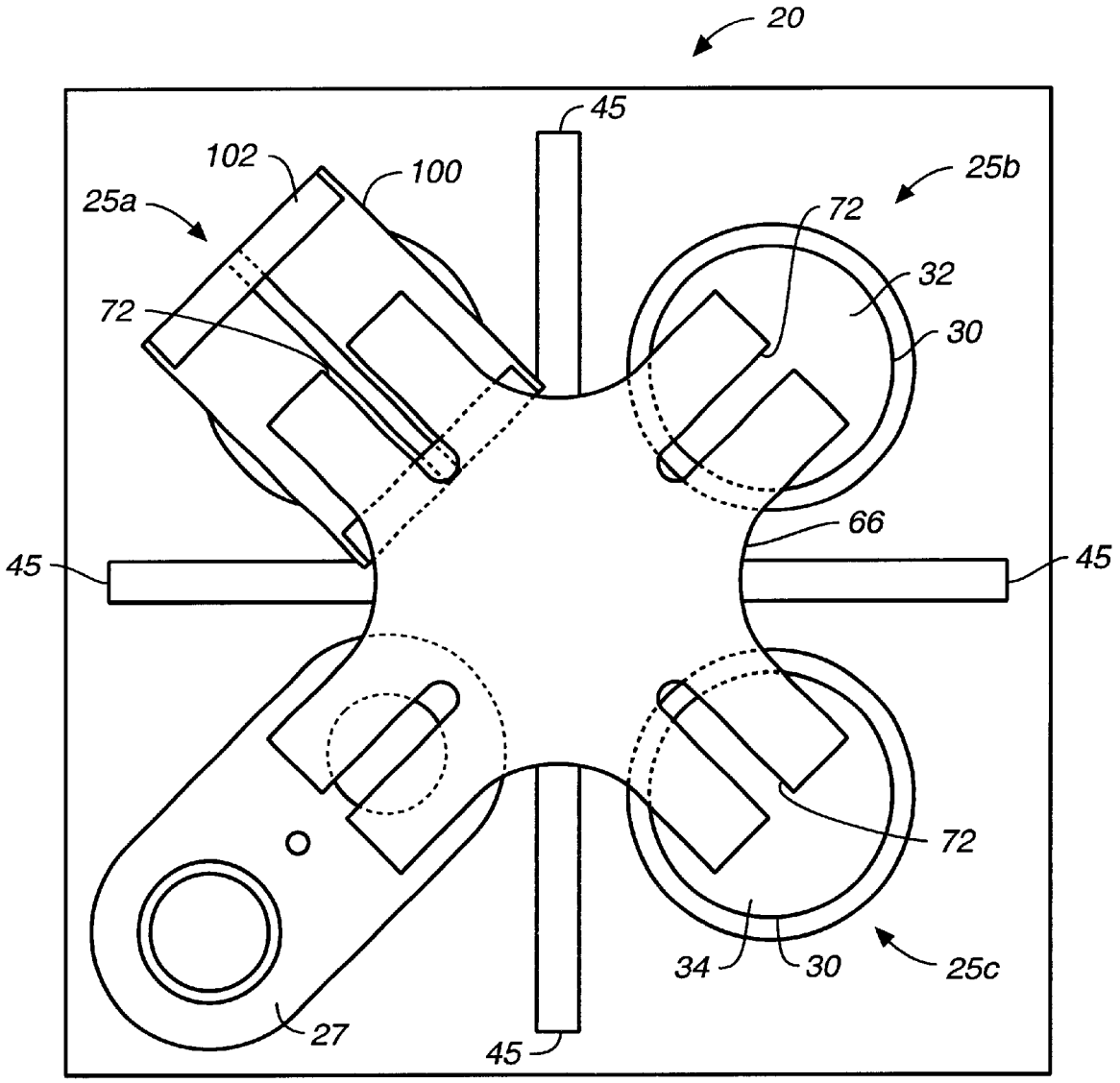
FIG. 2 is a top view of the CMP apparatus of FIG. 1.

Referring to FIGS. 1 and 2, one or more substrates 10 will be polished by a chemical mechanical polishing apparatus 20. Descriptions of similar polishing apparatus may be found in U.S. Pat. No. 5,738,574, and in U.S. patent application Ser. No. 09/244,456, filed Feb. 4, 1999, the entire disclosures of which is incorporated herein by reference. The polishing apparatus 20 includes a machine base 22 with a table top 23 that supports a series of polishing stations, including a first polishing station 25*a,* a second polishing station 25*b,* and a final polishing station 25*c,* and a transfer station 27. The transfer station 27 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen. At least one of the polishing stations, such as the first station 25*a,* includes a polishing cartridge 102 mounted to a rotatable, rectangular platen 100. The polishing cartridge 102 includes a linearly advanceable sheet or belt of polishing material, e.g., a fixed-abrasive polishing material. The remaining polishing stations, e.g., the second polishing station 25*b* and the final polishing station 25*c,* may include polishing pads 32 and 34, respectively, that are adhesively attached to circular platens 30. Each platen may be connected to a platen drive motor (not shown) that rotates the platen at thirty to two hundred revolutions per minute, although lower or higher rotational speeds may be used. Assuming that substrate 10 is an "eight-inch" (200 mm) diameter disk, the rectangular platen 100 may be about twenty inches on a side, and the circular platens 30 and polishing pads 32 and 34 may be about thirty inches in diameter.

Each polishing station 25*a,* 25*b* and 25*c* also includes a combined slurry/rinse arm 52 that projects over the associated polishing surface. Each slurry/rinse arm 52 may include two or more slurry supply tubes to provide a polishing liquid, slurry, or cleaning liquid to the surface of the polishing pad. For example, the polishing liquid dispensed onto a fixed abrasive polishing sheet or a final polishing pad typically does not include abrasive particles, whereas a slurry dispensed onto a standard polishing pad typically includes abrasive particles. Typically, sufficient liquid is provided to cover and wet the entire polishing pad. Each slurry/rinse arm also includes several spray nozzles (not shown) which provide a high-pressure rinse at the end of each polishing and conditioning cycle.

The polishing stations that include a standard polishing pad, i.e., the second and final polishing stations 25*b* and 25*c,* may include an optional associated pad conditioner apparatus 40. The polishing stations that include a fixed-abrasive polishing pad, i.e., the first polishing station 25*a,* may include an optional unillustrated cleaning apparatus to remove grit or polishing debris from the surface of the polishing sheet. The cleaning apparatus may include a rotatable brush to sweep the surface of the polishing sheet and/or a nozzle to spray a pressurized cleaning liquid, e.g., deionized water, onto the surface of the polishing sheet. The cleaning apparatus can be operated continuously, or between polishing operations. In addition, the cleaning apparatus could be stationary, or it could sweep across the surface of the polishing sheet. In addition, optional cleaning stations 45 may be positioned between adjacent polishing stations and between the polishing stations and the transfer station 27 to clean the substrate as it moves between the stations.

A rotatable multi-head carousel 60 is supported above the polishing stations by a center post 62 and is rotated about a carousel axis 64 by a carousel motor assembly. The carousel 60 includes four carrier head systems mounted on a carousel support plate 66 at equal angular intervals about carousel axis 64. Three of the carrier head systems receive and hold substrates, and polish them by pressing them against the polishing sheet of the first station 25*a* and the polishing pads of the second and final stations 25*b* and 25*c.* One of the carrier head systems receives a substrate from and delivers a substrate to the transfer station 27.

Each carrier head system includes a carrier or carrier head 80. A carrier drive shaft 78 connects a carrier head rotation motor 76 (shown by the removal of one quarter of the carousel cover) to the carrier head 80 so that each carrier head can independently rotate about its own axis. In addition, each carrier head 80 independently laterally oscillates in a radial slot 72 formed in the carousel support plate 66.

The carrier head 80 performs several mechanical functions. Generally, the carrier head holds the substrate against the polishing surface, evenly distributes a downward pressure across the back surface of the substrate, transfers torque from the drive shaft to the substrate, and ensures that the substrate does not slip out from beneath the carrier head during polishing operations. Descriptions of a suitable carrier head may be found in U.S. patent application Ser. No. 08/861,260, filed May 21, 1997 and U.S. patent application Ser. No. 09/470,820, filed Dec. 23, 1999, the disclosures of which are incorporated herein by reference.

Figure 3A:
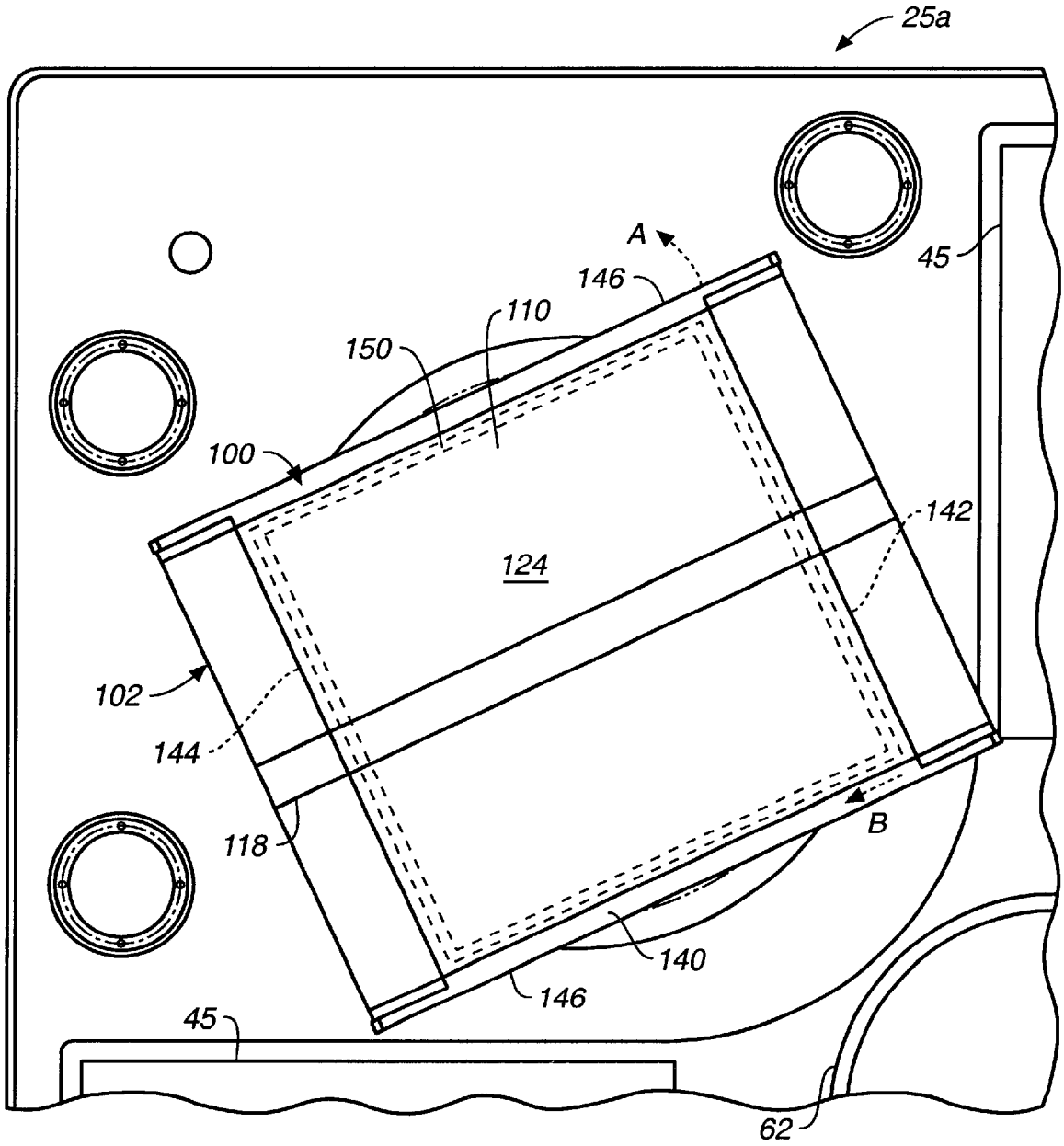
FIG. 3A is a top view of the first polishing station of the CMP apparatus of FIG. 1.
Figure 3B:
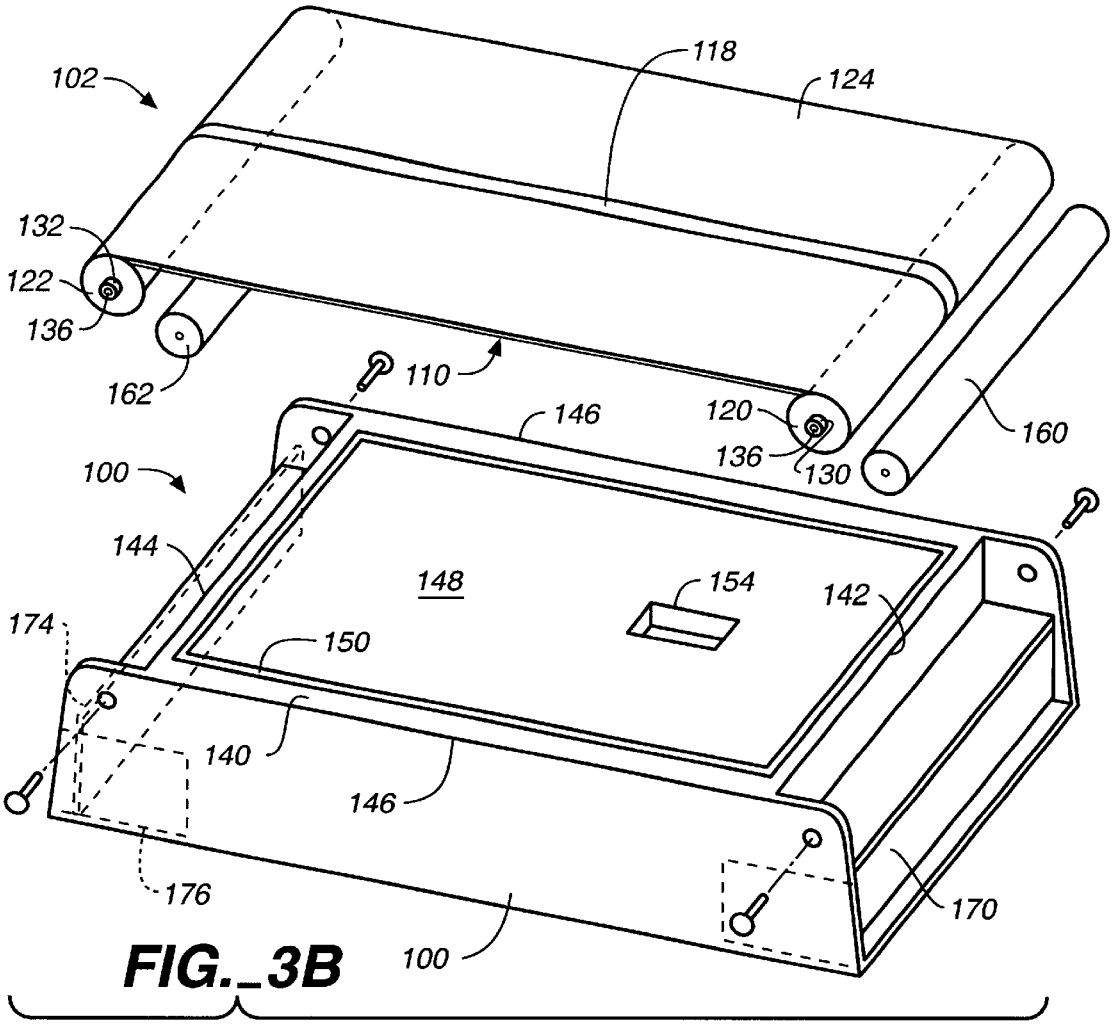
FIG. 3B is a schematic exploded perspective view of a rectangular platen and a polishing cartridge.
Figure 3C:
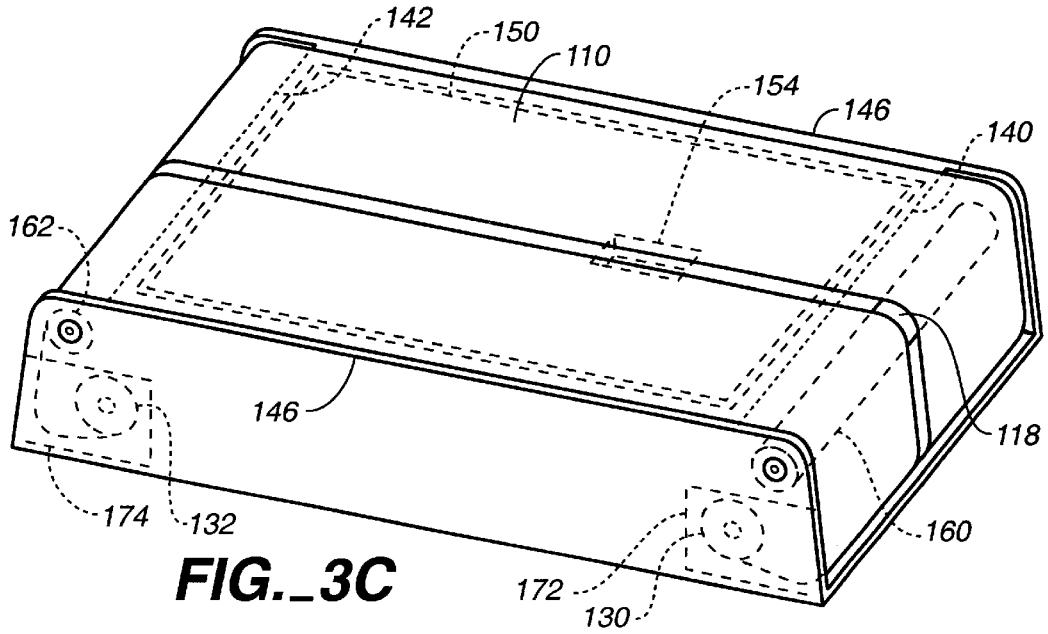
FIG. 3C is a schematic perspective view of a polishing cartridge attached to a rectangular platen.

Referring to FIGS. 3A, 3B, and 3C, the polishing cartridge 102 is detachably secured to the rectangular platen 100 at the first polishing station 25*a*. The polishing cartridge 102 includes a feed roller 130, a take-up roller 132, and a generally linear sheet or belt 110 of a polishing pad material. An unused or "fresh" portion 120 of the polishing sheet 110 is wrapped around the feed roller 130, and a used portion 122 of the polishing sheet 110 is wrapped around the take-up roller 132. A rectangular exposed portion 124 of the polishing sheet that is used to polish substrates extends between the used and unused portions 120, 122 over a top surface 140 of the rectangular platen 100. The polishing sheet may be a fixed-abrasive polishing material, such as a polyester belt that carries silicon oxide abrasive particles, available from 3M Corporation of Minneapolis, Minn. A transparent strip 118 can be formed along the length of the polishing sheet 110 by excluding abrasive particles from this region of the containment media. The transparent strip can be aligned with an aperture or transparent window 154 in rectangular platen 100 to provide optical monitoring of the substrate surface for end point detection.

The rectangular platen 100 can be rotated (as shown by phantom arrow "A" in FIG. 3A) to rotate the exposed portion of the polishing sheet and thereby provide relative motion between the substrate and the polishing sheet during polishing. Between polishing operations, the polishing sheet can be advanced (as shown by phantom arrow "B" in FIG. 3A) to expose an unused portion of the polishing sheet. When the polishing material advances, polishing sheet 110 unwraps from feed roller 130, moves across the top surface of the rectangular platen, and is taken up by take-up roller 132.

The feed and take-up rollers 130 and 132 should be slightly longer than the width of polishing sheet 110. The rollers 130, 132 may be plastic or metal cylinders about 20" long and about 2" in diameter. In addition, both end faces 136 of each roller may be chamfered to prevent polishing sheet 110 from slipping laterally.

Still referring to FIGS. 3A, 3B and 3C, rectangular platen 100 includes a generally planar rectangular top surface 140 bounded by a feed edge 142, a take-up edge 144, and two parallel lateral edges 146. A groove 150 (shown in phantom in FIGS. 3A and 3C) is formed in the top surface 140. The groove 150 may be a generally-rectangular pattern that extends along the edges 142–146 of the top surface 140. A passage 152 (see FIG. 5) through the platen 100 connects the groove 150 to a vacuum source. When the passage 152 is evacuated, the exposed portion 124 of the polishing sheet 110 is vacuum-chucked to the top surface 140 of the platen 100. This vacuum-chucking helps ensure that lateral forces caused by friction between the substrate and the polishing sheet during polishing do not force the polishing sheet off the platen. A central region 148 of the top surface 140 is free from grooves to prevent potential deflection of the polishing sheet into the grooves from interfering with the polishing uniformity.

Figure 4:
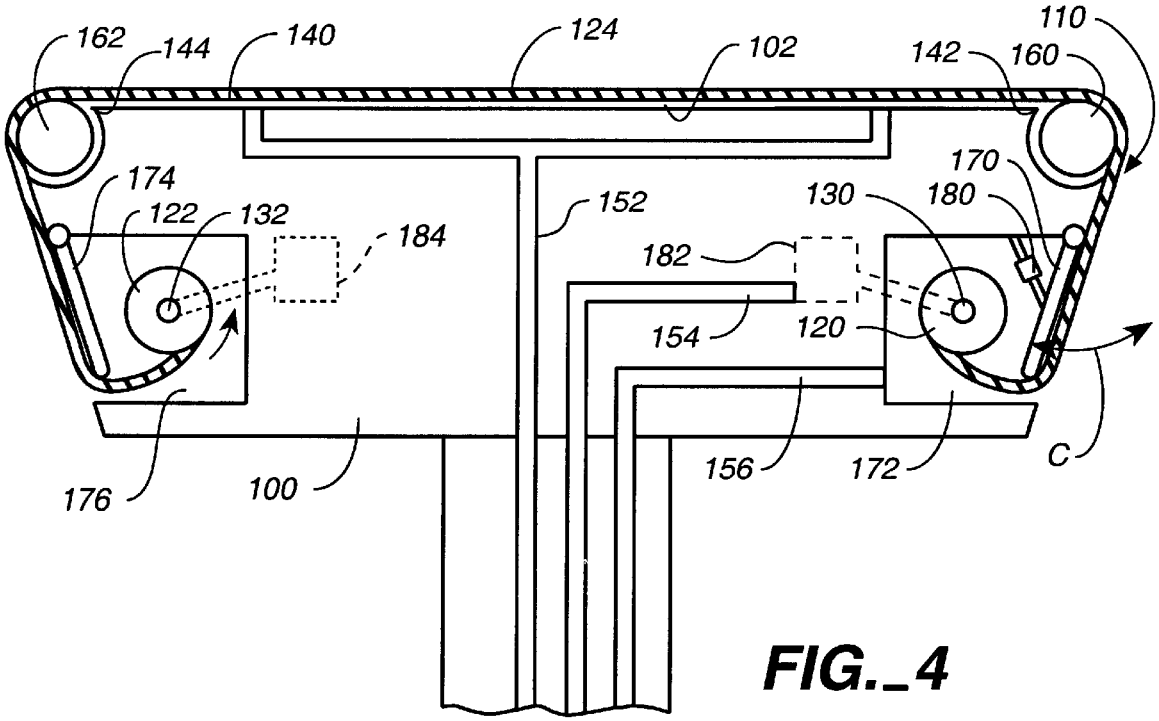
FIG. 4 is a schematic cross-sectional view of the polishing station of FIG. 3A.

As illustrated by FIGS. 3B, 3C and 4, the rectangular platen 100 includes two rollers 160 and 162 positioned at the feed edge 142 and take-up edge 144 of the rectangular top surface 140, respectively. A first door 170 is pivotally attached to the feed side of the platen 100 to form a cavity 172 into which the feed roller 130 can be inserted. Similarly, a second first door 174 (shown in phantom in FIG. 3B) is pivotally attached to the take-up side of the platen 100 to form a cavity 176 into which the take-up roller 132 can be inserted. When the feed roller 130 and take-up roller 132 are inserted into place, the polishing sheet 110 extends through a slot between the bottom of the first door 170 and the platen 100, upwardly around the first roller 160, across the rectangular top surface 140, around the second roller 162, and through a slot between the bottom of the second door 174 and the platen.

A pneumatic cylinder 180 connects the first door 170 to the platen 100 to pivot the first door 170 inwardly or outwardly, as shown by arrow C. When the feed roller 130 is inserted into the cavity 172, it engages an adjustable slip clutch 182. Similarly, when the take-up roller 132 is inserted into the cavity 176, it engages a one-way overrunning clutch 184. The adjustable slip clutch 182 and one-way overrunning clutch 184 are illustrated schematically and in phantom. The adjustable slip clutch 182 prevents the feed roller 130 from rotating to advance the polishing sheet 110 unless the applied force is greater than some threshold force. In addition, the slip clutch 182 prevents the feed roller 130 from rotating "backwards", i.e., to rewind the polishing sheet onto the feed roller 130. The one-way overruning clutch 184 can be a pneumatic motor that provides a constant rotary force to the take-up roller 132. The pneumatic motor may be powered by a pneumatic control line 154. This torque rotates the take-up roller 132 in a direction that winds the polishing sheet 110 onto the take-up roller 132. However, the rotary force applied by the overruning clutch 184 is not sufficient to overcome the slip clutch 182. Thus, the one-way overruning clutch 184 and adjustable slip clutch 182 maintain the polishing sheet 110 in a state of tension with the exposed portion of the polishing sheet 110 stretched across the top surface of the platen 100.

A compressible backing pad 102 may be placed on the top surface of the platen to cushion the impact of the substrate against the polishing sheet. In addition, platen 100 may include an unillustrated shim plate. Shim plates of differing thickness may be attached to the platen to adjust the vertical position of the top surface of platen. The compressible backing pad can be attached to the shim plate.

In operation, the exposed portion 124 of the polishing sheet 110 is vacuum-chucked to the rectangular platen 100 by applying a vacuum to the passage 152. A substrate is lowered into contact with the polishing sheet 110 by the carrier head 80, and both the platen 100 and the carrier head 80 rotate to polish the exposed surface of the substrate. After polishing, the substrate is lifted off the polishing sheet 110 by the carrier head 80. With the vacuum on passage 152 still active, the pneumatic cylinder 180 pushes the first pivoting door 170 outwardly by a predetermined distance. Since the outward force from the pneumatic cylinder 180 overcomes the adjustable slip clutch 182, the feed roller 130 can rotate to play out a segment of the polishing sheet 110. Then the pneumatic cylinder 180 pulls the first door inwardly, leaving slack in the polishing sheet 110 between the feed roller 130 and the top surface 124 of the platen 100. The vacuum on the passage 152 is removed to release the vacuum pulldown that holds the polishing sheet 110 on the platen. In addition, a fluid (such as air) can be forced through the passage 152 and the groove 150 to create a fluid bearing between the polishing sheet 110 and the top surface 124 of the platen 100 and reduce the friction therebetween. While the polishing sheet is free to move, the torque from the one-way overruning clutch 184 rotates the take-up roller 132 and winds the polishing sheet 110 until it is pulled taught over the platen 100. This advances a fresh segment of the polishing sheet onto the top surface 124 of the platen. However, as previously noted, the rotary force applied by the overruning clutch 184 is not sufficient to overcome the slip clutch 182. Thus, the polishing sheet 110 advances only by the amount played out when the pneumatic actuator 180 pushed out the first door 170. Vacuum is reapplied to the passage 152 to vacuum-chuck the polishing sheet 110 to the rectangular platen 100, and a new substrate is lowered into contact with the polishing sheet. Thus, between each polishing operation, the polishing sheet may be advanced incrementally. If the polishing station includes a cleaning apparatus, the polishing sheet may be washed between each polishing operation.

The amount that the sheet may be advanced will depend on the desired polishing uniformity and the properties of the polishing sheet, but should be on the order of 0.05 to 1.0 inches, e.g., 0.4 inch, per polishing operation. Assuming that the exposed portion 124 of polishing sheet is 20 inches long and the polishing sheet advances 0.4 inches after each polishing operation, the entire exposed portion of the polishing sheet will be replaced after about fifty polishing operations.

It should be noted that in an advancing mechanism that operates by rotating one of the rollers through a fixed angle, the length of polishing sheet played out varies. For example, if the polishing sheet was advanced by rotating the take-up roller through a fixed angle, the distance that the polishing sheet advances each operation would gradually increase (because the effective radius and circumference of the polishing sheet on the take-up roller increases as the polishing sheet accumulates on the take-up roller). In such a polishing device, the polishing rate may not be uniform, because the amount of fresh polishing sheet exposed changes from substrate to substrate. In contrast, an advantage of the polishing sheet advancing mechanism of polishing apparatus 20 is that a fixed length of the polishing sheet 110 is played out at each operation, independent of the amount of the polishing sheet remaining on the rollers 130 and 132. By playing out a fixed length of the polishing sheet 110 at each operation, polishing uniformity can be improved.

One problem that can occur with an advanceable polishing sheet is that the "fresh" portion of the polishing sheet can become contaminated, e.g., with slurry or other debris from the polishing process. To prevent water and other polishing products from contaminating the "fresh" portion 120 of the polishing sheet 110, a purge gas, such as nitrogen, is pumped into the supply roll cavity 170 through a fluid line 156. The purge gas can raise the pressure inside the supply roll cavity 170 to be higher than atmospheric pressure. The high pressure prevents the polishing products from entering the supply roll cavity 170. This prevents premature contamination of the polishing sheet 110, thereby decreasing defects and increasing yield.

Although the CMP apparatus is described a vacuum chucking the polishing sheet to the platen, other techniques could be used to secure the polishing sheet to the platen during polishing. For example, the edges of the polishing sheet could be clamped to the sides of the platen by a set of clamps.

In addition, although the CMP apparatus is described as having one rectangular platen with a fixed-abrasive polishing sheet and two circular platens with standard polishing pads, other configurations are possible. For example, the apparatus can include one, two or three rectangular platens. In fact, one advantage of CMP apparatus 20 is that each platen base 170 is adaptable to receive either a rectangular platen or a circular platen. The polishing sheet on each rectangular platen may be a fixed abrasive or a non-fixed abrasive polishing material. Similarly, each polishing pad on the circular platen can be a fixed-abrasive or a non-fixed abrasive polishing material. The standard polishing pads can have a single hard layer (e.g., IC-1000), a single soft layer (e.g., as in a Polytex pad), or two stacked layers (e.g., as in a combined IC-1000/SUBA IV polishing pad). Different slurries and different polishing parameters, e.g., carrier head rotation rate, platen rotation rate, carrier head pressure, can be used at the different polishing stations.

The invention is not limited to the embodiment depicted and described. Rather, the scope of the invention is defined by the appended claims.

What is claimed is:

1. A chemical mechanical polishing apparatus, comprising:

a rotatable platen;

a feed roller located in a cavity in the platen;

a take-up roller;

a generally linear polishing sheet releasably secured to the platen to rotate with the platen, the polishing sheet having an exposed portion extending over a top surface of the platen for polishing the substrate, an unused portion wound around the feed roller, and a used portion wound around the take-up roller;

a drive mechanism to incrementally advance the polishing sheet in a linear direction across the top surface of the platen; and a gas source that directs a purge gas into the cavity containing the feed roller.

2. The apparatus of claim 1, wherein the purge gas maintains the cavity at a pressure greater than atmospheric pressure.

3. The apparatus of claim 1, wherein the purge gas is nitrogen.

4. The apparatus of claim 1, further comprising a door to the cavity pivotally attached to the platen.

5. A method of operating a chemical mechanical polishing apparatus, comprising:

positioning a generally linear polishing sheet with an unused portion wound around a feed roller in a cavity of a rotatable platen, an exposed portion extending over a top surface of the platen, and a used portion wound around a take-up roller;

directing a purge gas into the cavity containing the feed roller;

rotating the platen; and incrementally advancing the polishing sheet in a linear direction across the top surface of the platen.

6. The method of claim 5, wherein the purge gas maintains the cavity at a pressure greater than atmospheric pressure.

7. The apparatus of claim 5, wherein the purge gas is nitrogen.

* * * * *